US007943843B2

(12) United States Patent
Komatsu

(10) Patent No.: US 7,943,843 B2
(45) Date of Patent: May 17, 2011

(54) REACTIVE FORCE CONTROL APPARATUS FOR PEDAL OF ELECTRONIC KEYBOARD INSTRUMENT

(75) Inventor: Akihiko Komatsu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 134 days.

(21) Appl. No.: 12/490,691

(22) Filed: Jun. 24, 2009

(65) Prior Publication Data

US 2009/0314156 A1 Dec. 24, 2009

(30) Foreign Application Priority Data

Jun. 24, 2008 (JP) ..... 2008-165039

(51) Int. Cl.
*G10H 1/00* (2006.01)

(52) U.S. Cl. ..... 84/615; 84/658; 84/653; 84/600

(58) Field of Classification Search ..... 84/600–602, 84/615, 653, 658

See application file for complete search history.

(56) References Cited

U.S. PATENT DOCUMENTS

| | | | | |
|---|---|---|---|---|
| 5,451,706 | A * | 9/1995 | Yamamoto et al. | 84/34 |
| 5,922,983 | A | 7/1999 | Muramatsu | |
| 6,121,535 | A | 9/2000 | Muramatsu | |
| 7,095,202 | B2 * | 8/2006 | Muramatsu | 318/568.12 |
| 7,217,881 | B2 * | 5/2007 | Muramatsu | 84/723 |
| 2006/0090633 | A1 * | 5/2006 | Muramatsu | 84/723 |
| 2007/0006847 | A1 * | 1/2007 | Gregorio | 123/399 |
| 2007/0244641 | A1 * | 10/2007 | Altan et al. | 701/300 |
| 2008/0283024 | A1 * | 11/2008 | Gregorio | 123/399 |
| 2009/0314156 | A1 * | 12/2009 | Komatsu | 84/626 |
| 2010/0031803 | A1 * | 2/2010 | Lozada et al. | 84/439 |

FOREIGN PATENT DOCUMENTS

| | | | |
|---|---|---|---|
| JP | 08103000 | A * | 4/1996 |
| JP | 2001-022355 | | 1/2001 |
| JP | 2004-334008 | | 11/2004 |
| JP | 2004334008 | A * | 11/2004 |
| JP | 2006-6146259 | | 6/2006 |

* cited by examiner

*Primary Examiner* — David S. Warren
(74) *Attorney, Agent, or Firm* — Morrison & Foerster LLP

(57) ABSTRACT

Reactive force control apparatus for a pedal comprises: a movement detection section that detects movement of the pedal; a solenoid that produces a reactive force in response to operation of the pedal; a reference reactive force impartment table defining intensities of the reactive force corresponding to amounts of the operation of the pedal; a setting value input section operable to input a setting value for changing the reactive force responsive to the operation of the pedal; and a control section that controls the reactive force to the pedal by changing content of the table, on the basis of the input setting value, to thereby create a changed reactive force impartment table, so that the reactive force to the pedal is controlled on the basis of the changed table and detected movement of the pedal.

5 Claims, 12 Drawing Sheets

| PEDAL DISPLACEMENT (X) | ~ | −3 | −2 | −1 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | ~ |
|---|---|---|---|---|---|---|---|---|---|---|---|---|---|---|---|---|---|---|---|---|---|---|---|---|---|---|---|---|---|---|---|
| REACTIVE FORCE BY SOLENOID (F2) | | 0 | 0 | 0 | 0 | 0 | 0 | 0 | 0 | 0 | 0 | 2 | 4 | 6 | 8 | 10 | 12 | 13 | 13 | 13 | 13 | 13 | 13 | 13 | 13 | 15 | 18 | 22 | .. | .. | |

A1 A2 A3

| PEDAL DISPLACEMENT (X) | ~ | -3 | -2 | -1 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | ~ |
|---|---|---|---|---|---|---|---|---|---|---|---|---|---|---|---|---|---|---|---|---|---|---|---|---|---|---|---|---|---|---|---|
| REACTIVE FORCE BY SOLENOID (F2) | | | | 0 | 0 | 0 | 0 | 0 | 0 | 0 | 0 | 0 | 0 | 2 | 4 | 6 | 8 | 10 | 12 | 13 | 13 | 13 | 13 | 13 | 13 | 13 | 13 | 15 | 18 | 22 | |
| | | | | | A1 | | | | | | | | | A2 | | | | | | A3 | | | | | | | | | | | |

| PEDAL DISPLACEMENT (X) | ~ | -3 | -2 | -1 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | ~ |
|---|---|---|---|---|---|---|---|---|---|---|---|---|---|---|---|---|---|---|---|---|---|---|---|---|---|---|---|---|---|---|---|
| REACTIVE FORCE BY SOLENOID (F2) | 0 | 0 | 0 | 0 | 0 | 0 | 0 | 0 | 0 | 2 | 4 | 6 | 8 | 10 | 12 | 13 | 13 | 13 | 13 | 13 | 13 | 13 | 13 | 15 | 18 | 22 | .. | .. | .. | .. | |

A1 A2 A3

| PEDAL DISPLACEMENT (X) | ~ | -3 | -2 | -1 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | ~ |
|---|---|---|---|---|---|---|---|---|---|---|---|---|---|---|---|---|---|---|---|---|---|---|---|---|---|---|---|---|---|---|---|
| REACTIVE FORCE BY SOLENOID (F2) | | 0 | 0 | 0 | 0 | 0 | 0 | 0 | 0 | 0 | 0 | 2.4 | 4.8 | 7.2 | 9.6 | 12 | 14.4 | 15.6 | 15.6 | 15.6 | 15.6 | 15.6 | 15.6 | 15.6 | 15.6 | 18 | 21.6 | 26.4 | .. | .. | |

A1 A2 A3

| PEDAL DISPLACEMENT (X) | ~ | -3 | -2 | -1 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | ~ |
|---|---|---|---|---|---|---|---|---|---|---|---|---|---|---|---|---|---|---|---|---|---|---|---|---|---|---|---|---|---|---|---|
| REACTIVE FORCE BY SOLENOID (F2) | | 2 | 2 | 2 | 2 | 2 | 2 | 2 | 2 | 2 | 2 | 4 | 6 | 8 | 10 | 12 | 14 | 15 | 15 | 15 | 15 | 15 | 15 | 15 | 15 | 17 | 20 | 24 | .. | .. | |

A1 A2 A3

REACTIVE FORCE CONTROL APPARATUS FOR PEDAL OF ELECTRONIC KEYBOARD INSTRUMENT

BACKGROUND

The present invention relates generally to reactive force control apparatus for controlling a reactive force responsive to operation of a pedal of an electronic keyboard instrument, and more particularly to an improved reactive force control apparatus for a pedal of an electronic keyboard instrument which can achieve an operational feeling of the pedal approximate to that of a natural keyboard instrument, such as an acoustic piano.

The acoustic pianos have a mechanism for generating a tone by causing a hammer to strike a string in response to depression of a key, and the thus-generated tone differs in its sounding manner and volume depending on an intensity and speed of the key depression. Further, the acoustic pianos have pedals for controlling resonance of a tone; the grand pianos, for example, have a damper pedal, sostenute pedal and soft pedal.

The damper pedal is a pedal that controls dampers for stopping vibrations of strings. The dampers are provided in one-to-one corresponding relation to the strings. Each of the dampers is connected to the damper pedal (hereinafter sometimes referred to as "pedal") via some connecting portions. Once the pedal (damper pedal) is pushed or pressed down, all of the dampers corresponding to the strings are released, so that, even if a human player releases its finger from an operated key, tone deadening by the corresponding damper does not take place and thus the tone of the depressed key remains sounding for a given time. In this case, all of the strings, including those corresponding to non-depressed keys, resonate so that harmonics sound clearly. Thus, the human player can impart various expression to tones generated by the piano.

Further, so-called "play" is provided in the connecting portions between each of the dampers and the pedal. With such play, the human player can not only have his or her foot always placed on the pedal but also perform so-called half pedal operation of lightly pushing or pressing down the pedal to a partway position such that the damper slightly retrains the string. With the pedal pressed down lightly, the damper does not operate and is pushed up only when the pedal is pressed down to a predetermined position. Thus, a reactive force (i.e., load on the human player's foot) due to the pressing-down of the pedal suddenly starts varying stepwise at the time point when the pushing-up of the damper is started.

Among electronic keyboard instruments emulating tone colors, operability and outer appearances of the aforementioned acoustic pianos are electronic pianos. Among such electronic pianos are ones equipped with three pedals functioning similarly to the damper pedal, sostenute pedal and soft pedal of the grand piano. The electronic pianos, however, do not have to perform an operation for releasing a damper from a string because they do not generate a tone by actually striking the string. Instead, the electronic pianos are constructed to electronically perform a process corresponding to pedal operation so as to generate a tone equivalent to that generated by the pedal operation. Thus, in the electronic pianos, a pedal device itself is simple in mechanism; for example, a springs etc. are provided between the pedal pivotably mounted to a frame and a bottom plate so that upward reactive force is normally imparted to the pedal by the biasing force of the spring.

In one known example of the pedal devices of the electronic pianos, the pedal is normally urged by a single spring, as disclosed in Japanese Patent Application Laid-open Publication No. 2001-22355. With the biasing force of the single spring, however, it is not possible to produce stepwise variation of a reactive force like that produced at the time of the damper push-up in the grand piano. Consequently, if a human player experienced in playing an acoustic piano plays the electronic piano, the human player may feel uncomfortable due to a difference in playing feeling and can not grasp a half pedal position sensuously.

Thus, Japanese Patent Application Laid-open Publication No. 2004-334008 discloses an improved pedal device, which includes first and second springs so that a biasing force of the first spring alone and a combined biasing force of the first and second springs are sequentially imparted to the pedal in response to a changing displaced amount of the pedal in such a manner that the reactive force of the pedal can change or vary in a stepwise manner. Although the combination of the biasing forces of the plurality of springs permits stepwise variation of the reactive force, the biasing forces of the springs can provide only one distribution pattern of reactive force intensities, and thus, the reactive force can not be varied or changed as desired in response to an input setting and/or actual operation by a human player.

Further, a reactive force control apparatus disclosed in Japanese Patent Application Laid-open Publication No. 2006-146259 includes a solenoid for driving an operating member in the form of a key, and a reactive force control section for controlling the solenoid. With such an arrangement, it is possible to adjust an operating feeling of the operating member through an electric driving force and vary a reactive force to the operating member in response to actual operation of the operating member. However, because the reactive force control apparatus disclosed in the No. 2006-146259 publication generates solenoid driving instructing values on the basis of a table selected from among a plurality of tables, a human player can not set the reactive force of the operating member at a position and intensity desired by the human player itself. Thus, the operational feeling of the operating member can not be varied freely by the human player.

SUMMARY OF THE INVENTION

In view of the foregoing, it is an object of the present invention to provide an improved reactive force control apparatus for a pedal of an electronic keyboard instrument which can vary a reactive force to an operating member in the form of a pedal in accordance with an input setting and which can achieve an operational feeling of the pedal as desired by a human player.

In order to accomplish the above-mentioned object, the present invention provides an improved reactive force control apparatus for a pedal of an electronic keyboard apparatus, which comprises: a pedal supported for movement in response to depression/release operation performed thereon; a movement detection section that detects movement of the pedal; a drive section that produces a reactive force to be imparted to the pedal, based on an electric driving force thereof, in response to the depression/release operation of the pedal; a reference reactive force impartment table defining intensities of the reactive force corresponding to amounts of the depression/release operation of the pedal; a setting value input section operable to input a setting value for setting a reactive force responsive to the depression/release operation of the pedal; and a reactive force control section that controls the reactive force to be produced by the drive section, the reactive force control section changing content of the reference reactive force impartment table, on the basis of the setting value inputted via the setting value input section, to thereby create a changed reactive force impartment table, so that the reactive force control section controls the reactive force to be produced by the drive section by referring to the changed reactive force impartment table in accordance with a pedal movement detection signal outputted by the movement detection section.

With the reactive force control apparatus for a pedal of an electronic keyboard apparatus of the present invention, any desired reactive force responsive to pressing-down operation of the pedal can be set by a user or human player inputting a setting value via the setting value input section. Consequently, the reactive force control apparatus of the present invention can change an operational feeling of the pedal to another operational feeling as desired by the human player; namely, the present invention can achieve an operational feeling of the pedal as desired by the human player. Thus, in the pedal of the electronic keyboard, a reactive force in the half pedal region can be reproduced at a position (reactive-force imparting position responsive to displacement of the pedal) and/or intensity as desired by the human player. As a result, the human player can perform advanced performance operation for varying a color etc. of a tone by minutely changing a pressed-down depth or amount of the pedal.

In a preferred embodiment, the reactive force to be imparted to the pedal has a characteristic that a variation rate of the reactive force responsive to the depression/release amount of the pedal changes at a particular displacement amount in a displaceable region of the pedal, and the reactive force control section creates the changed reactive force impartment table by changing, on the basis of the setting value inputted via the setting value input section, any one or more of the value of the particular displaced amount, variation rate of the reactive force in a predetermined region and intensity of the reactive force set in the reference reactive force impartment table.

Preferably, the reactive force control apparatus further comprises a biasing member that imparts a reactive force, based on a mechanical biasing force thereof, to the pedal in response to the operation of the pedal, and the displaceable region of the pedal has first to third regions continuous with each other, the reactive force to the pedal based on the reference reactive force impartment table and the biasing member having a greater variation rate in the second region than in the first and third regions. The reactive force based on the biasing force of the biasing member alone is imparted to the pedal in the first region while a combination of the reactive force based on the biasing force of the biasing member and the reactive force based on the electric driving force of the drive section is imparted to the pedal in the second and third regions, and the reactive force control section changes the reactive force to be imparted in the second and third regions, by changing, on the basis of the setting value inputted via the setting value input section, a position and/or intensity of the reactive force to be produced by the drive section.

Because a combination of the reactive force based on the biasing force of the biasing member and the reactive force based on the electric driving force of the drive section is imparted to the pedal, the drive section can be simplified in mechanism or construction so that the overall construction of the electronic keyboard can be simplified. Further, because the electric power required to drive the drive section can be reduced, it is possible to reduce the power consumption by the electronic keyboard. In this case too, the reactive force in the half pedal region can be reproduced at a position and/or intensity desired by the human player, because the inventive arrangement can change the reactive force in the second and third regions as desired by merely changing the reactive force to be produced by the drive section.

Preferably, the reactive force to the pedal based on the reference reactive force impartment table has a greater variation rate in the second region than in the first and third regions, the reference reactive force impartment table comprises first and second tables differing from each other in content, and the reactive force based on the first table alone is imparted to the pedal in the first region while a combination of the reactive forces based on the first and second tables is imparted to the pedal in the second and third regions.

By performing control using two different tables defining two different distributions of reactive force intensities, the present invention can adjust the position and/or intensity of the reactive force in the half pedal region as desired by the human player. Further, in this case, because only the drive section, which produces a reactive force based on an electric driving force thereof, is required as a mechanism for imparting the reactive force to the pedal, the present invention can significantly reduce the number of necessary component parts and simplify the construction of the electronic keyboard instrument.

Further, preferably, the reactive force control section changes the content of the second table, on the basis of the setting value inputted via the setting value input section, so that the reactive force control section changes the reactive force in the second and third regions by changing positions and/or intensities of the reactive force based on the second table. Thus, with only the drive section producing a reactive force based on an electric driving force thereof, the present invention can reproduce the reactive force in the half pedal region at a position and/or intensity as desired by the human player.

According to the aforementioned reactive force control apparatus for a pedal of an electronic keyboard apparatus of the present invention, the human player can set desired characteristics of the reactive force (e.g., position and/or intensity at which the reactive force is produced) responsive to pressing-down operation of the pedal. In addition, the human player can perform advanced performance operation for varying a color etc. of a tone using the half pedal region.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

In the following description, an area at or around one of two longitudinal sides of an electronic keyboard instrument which is closer to a human player is referred to as "front" and the like, and an area at or around the other longitudinal side of the electronic keyboard instrument which is remote from the human player is referred to as "back", "rear" and the like.

First Embodiment

Figure 1:
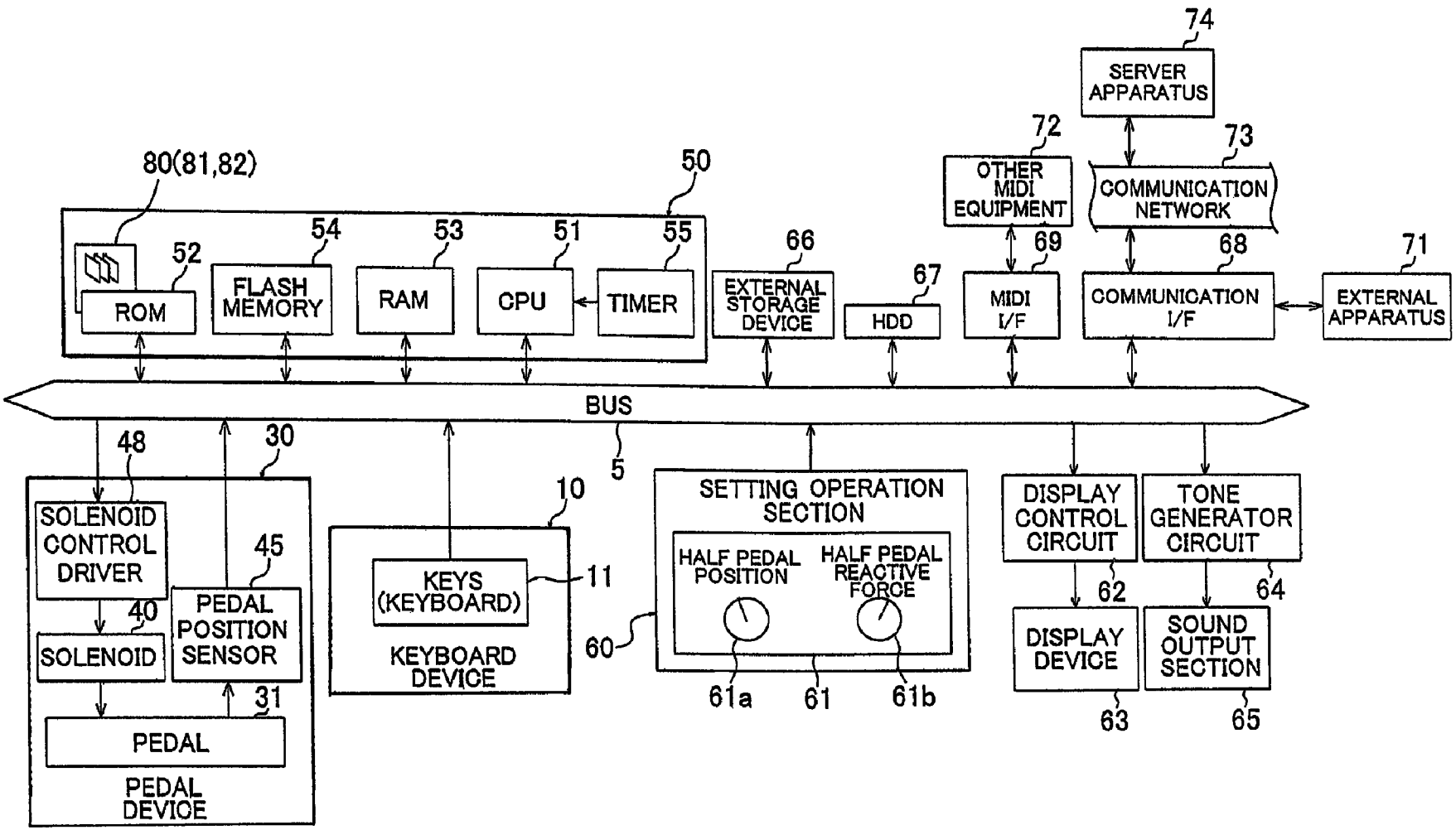
FIG. 1 is a block diagram showing a general construction of an electronic keyboard instrument provided with a first embodiment of a reactive force control apparatus of the present invention.

FIG. 1 is a block diagram showing a general construction of an electronic keyboard instrument provided with a reactive force control apparatus according to a first embodiment of the present invention. The electronic keyboard instrument of FIG. 1 includes a pedal device 30 including a pedal (operating member) 31, and a control section (reactive force control section) 50 for controlling a reactive force responsive to operation of the pedal 31. The pedal device 30 and control section 50 are interconnected via a bus 5. The electronic keyboard instrument also includes a keyboard device 10, including keys (keyboard) 11, which is connected to the control section 50 via the bus 5.

Figure 2A:
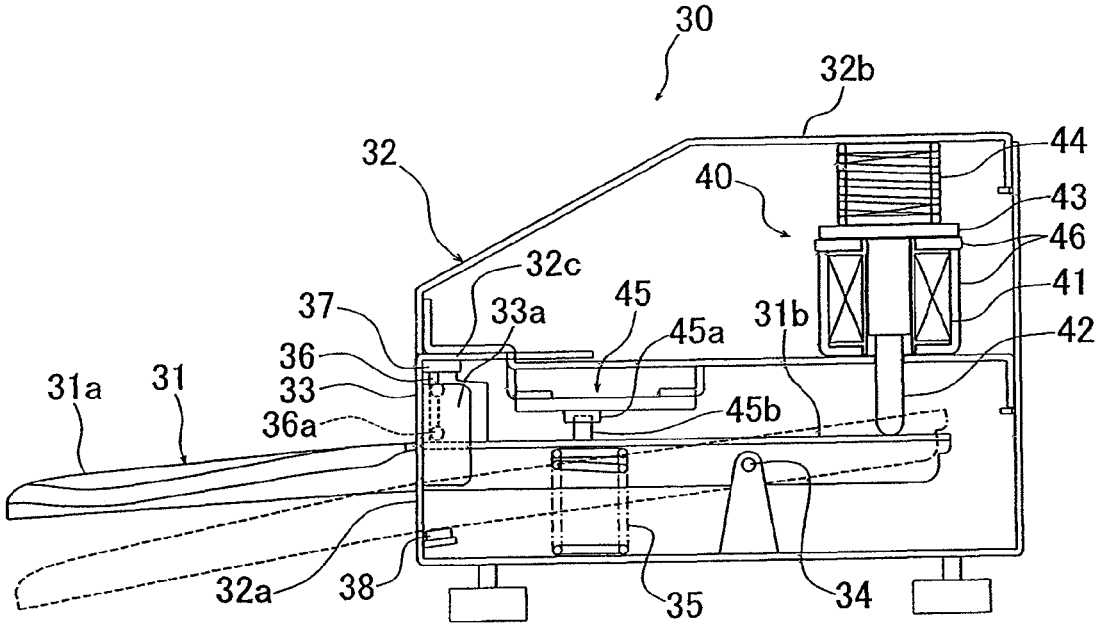
FIGS. 2A and 2B are a schematic sectional side view and front view, respectively, showing an example construction of the first embodiment of the pedal device.
Figure 2B:
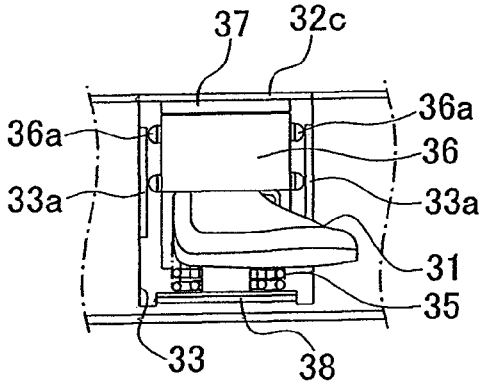

FIGS. 2A and 2B are a schematic sectional side view and front view, respectively, of the first embodiment of the pedal device 30. The pedal device 30 includes a plurality of pedals, corresponding to the damper pedal, sostenute pedal and soft pedal of the grand piano, pivotably supported on a frame 32. In the figures, however, there is shown only the pedal 31 corresponding to the damper pedal and located rightmost as viewed from a human player; illustration of the other pedals is omitted. Because the characteristic arrangements of the present invention are applied to the pedal 31 corresponding to the damper pedal, the following describe the pedal 31 and components around the pedal 31.

The frame 32 is formed in a substantially rectangular box shape by appropriately bending a plate member of metal or the like. The frame 32 is horizontally elongated to extend across areas the plurality of pedals, and the frame 32 has an opening portion 33 formed in a portion of a front wall 32*a* thereof where the pedal 31 is mounted. The pedal 31 is in the form of an elongated member of a substantially flat plate shape, and an operating portion 31*a* operable, or capable of being stepped or pressed down, by the human player is provided on a front region of the pedal 31, and the pedal 31 is mounted to the frame 32 at a mounting portion 31*b* provided on a rear region thereof. Bent plate members 33*a* of a generally flat plate shape, each bent rearward at an outer edge portion thereof, are provided on opposed inner peripheral surfaces of the opening portion 33.

With the mounting portion 31*b* inserted in the frame 32 through the opening portion 33, the operating portion 31*a* of the pedal 31 projects forwardly of the frame 32, the mounting portion 31*b* is supported at its intermediate position by a pedal supporting point 34 in such a manner that it is vertically pivotable about the pedal supporting point 34.

Return spring 35, which is a biasing member for producing a reactive force by its mechanical biasing force, is provided on the underside of the pedal 31 within the frame 32. The return spring 35 is a coil spring made of a metal or other resilient material and produces a biasing force (reactive force) by being compressed in its axial direction. The return spring 35 is located forwardly of the pedal supporting point 34 to normally urge upwardly a portion of the pedal 31.

The pedal device 30 further includes a solenoid 40 provided on the upper surface of the pedal 31 as a drive section for generating a reactive force, based on its electric driving force, in response to depression and/or release operation of the pedal 31. The solenoid 40 is located rearwardly of or behind the pedal supporting point 34, and it includes a coil 41 and a projectable/retractable rod 42 provided centrally in the coil 41. Yoke 46 (formed of a magnetic substance) covers upper and lower and side peripheral surfaces of the coil 41. The rod 42 has an axis extending vertically and has its lower end abutted against the upper surface of the pedal 31. Plate member 43 of a flat plate shape is fixed to the upper end of the rod 42 in such a manner that its general plane extends at a right angle to the axis of the rod 42. With the plate member 43 abutted against the upper end of the yoke 46, the lower end of the rod 42 abuts against the upper surface of the pedal 31 while the pedal 31 is in its initial position. Further, a coil spring (biasing member) 44 is provided between the plate member 43 and an upper wall 32*b* of the frame 32 overhanging the solenoid 40, so that the rod 42 is normally urged downward by the coil spring 44.

The pedal device 30 further includes a pedal position sensor (movement detecting section) 45 for detecting a current position of the pedal 31. The pedal position sensor 45 employed here is an optical sensor, which includes a shutter 45*a* fixed to the pedal 31 and a photo sensor 45*b* having its light path interruptable by the shutter 45*a*. The pedal position sensor 45 is shaped so that a light interruption amount of the light path continuously varies in response to positional variation (displacement) of the pedal 31, and thus, the current position of the pedal 31 is identifiable by the output signal of the photo sensor 45*b*. The pedal position sensor 45 may be a position sensor of any other suitable type than the aforementioned light-interrupting type, such as a position sensor of a reflection type that has a light receiving section and a light reflecting surface provided on the pedal 31 and capable of continuously varying the amount of reflected light in response to positional variation (displacement) of the pedal 31 and that detects the current position of the pedal 31 by the light receiving section receiving the reflected light from the reflecting surface, although not specifically shown in the drawings. Further, the pedal position sensor 45 may be replaced with a pedal position detecting switch, although not specifically shown. Further, whereas the foregoing have described the example where the pedal position sensor 45 is employed as the movement detector for detecting movement of the pedal 31, the pedal position sensor 45 may be replaced with any one or more of a pedal speed sensor, pedal acceleration sensor, pedal angle sensor and pedal angular speed sensor that detect a speed, acceleration, angle and angular speed, respectively, of the pedal 31.

The pedal 31 further includes a guide member 36, and the guide member 36 is a member of a substantially rectangular shape fixed to the front end of the mounting portion 31*b*. The guide member 36 has a plurality of small projections 36*a* on its opposite side surfaces (two small projections 36*a* on each of the side surfaces). The small projections 36*a* are abutted against the opposed inner surfaces of the bent plate members 33*a* of the frame 32. Thus, the guide member 36 guides pivoting movement of the pedal 31 by moving inside the bent plate members 33*a* with the small projections 36*a* sliding relative to the bent plate members 33*a* in response to the pivoting movement of the pedal 31.

Upper limit stopper 37 for defining an upper limit position of the pedal 31 is fixed to a wall surface 32*c* of the frame 32 opposed to the upper end of the guide member 36. The upper limit stopper 37 is formed of a shock absorbing material for lessening an impact caused by the guide member 36 colliding against the upper limit stopper 37. With the pedal 31 located at its uppermost position (hereinafter referred to as "initial position") prior to the start of pedal pressing-down operation by the human player, the upper end of the guide member 36 is kept in abutting contact with the upper limit stopper 37. Lower limit stopper 38 for defining a lower limit position of the pedal 31 is fixed to the lower end of the opening portion 33. The lower limit stopper 38 is also formed of a shock absorbing material for lessening an impact caused by the pedal 31 colliding against the lower limit stopper 38, and it is opposed to and spaced a predetermined distance from the lower surface of the pedal 31 resting in the initial position.

Although not specifically shown, the pedal device 30 also includes switch contacts, volume detection section and other mechanisms for converting the movement of the pedal 31 into an electric output.

Behavior of the pedal device 30 constructed in the aforementioned manner will be described below. While the pedal 31 is in the initial position, balance is achieved among the own weight of the pedal 31, resistance the guide member 36 receives from the upper limit stopper 37, biasing force of the return spring 35 and biasing force of the spring 44. Because of the balance achieved among the above-mentioned forces while the pedal 31 is in the initial position, the pedal 31 remains stationary with its front-to-rear (or longitudinal) length oriented in a substantially horizontal direction. As the pedal 31 in this state is pressed down by the human player, it pivots in a counterclockwise direction of FIG. 2A about the pedal supporting point 34, so that the return spring 35 pressed by the pedal 31 and the spring 44 are compressed to cause upward movement of the rod 42. Thus, a reactive force by the biasing force of the return spring 35 and a reactive force by the biasing force of the spring 44 are imparted to the pedal 31. As the pedal 31 is further pressed down, it abuts against, and hence is stopped by, the lower limit stopper 38. Then, as the force with which the pedal 31 is pressed down is weakened b the play, the pedal 31 pivots in a clockwise direction of FIG. 2A by the biasing forces of the return spring 35 and spring 44 and thereby returns to the initial position. If a voltage is applied to the coil 41 of the solenoid 40 to drive the rod 42 during the time the pedal 31 is pivoting by the biasing forces of the return spring 35 and spring 44, the reactive force imparted by the return spring 35 and spring 44 can be assisted by a reactive force produced by the solenoid 40. Thus, appropriate reactive force control can be performed on the reactive force responsive to the human player's operation of the pedal 31 by the control section 50 controlling the driving of the solenoid 40. Operational sequence of the reactive force control performed in the instant embodiment will be described later.

The following describe in detail the control section 50 of FIG. 1. The control section 50 includes a CPU 51, a ROM 52, a RAM 53 and a flash memory (EEPROM) 54. Timer 55 is connected to the CPU 51. The CPU 51 controls the entire electronic keyboard instrument including the pedal device 30 and keyboard apparatus 10. The ROM 52 and flash memory 54 have stored therein control programs for execution by the CPU 51, various table data and a later-described reactive force impartment table 80. The RAM 53 temporarily stores various input information, such as performance data and text data, various flags, buffer data, results of arithmetic operations, etc. The timer 55 counts times, such as times to signal interrupt timing for timer interrupt processes.

The electronic keyboard instrument includes, in addition to the aforementioned control section 50, a setting operation section 60, a display device 63, a sound output section 65, an external storage device 66, an HDD 67, a communication interface 68, a MIDI interface 69, etc. External apparatus 71 is connectable to the communication interface 68, and MIDI equipment 72 is connectable to the MIDI interface 69. Further, the communication interface 68 can communicate with an external server apparatus 74 via a communication network 73, such as the Internet. The setting operation section 60 includes various switches (not shown) usable or operable by the human player to enter setting operation information. each signal generated in response to operation of any one of the switches is supplied to the CPU 51. The external storage device 66 and HDD 67 store therein various application programs, including the above-mentioned control programs, and various music piece data. The display device 63 is connected to the bus 5 via a display control circuit 62, and the sound output section 65 is connected to the bus 5 via a tone generator circuit 64.

Figure 3:
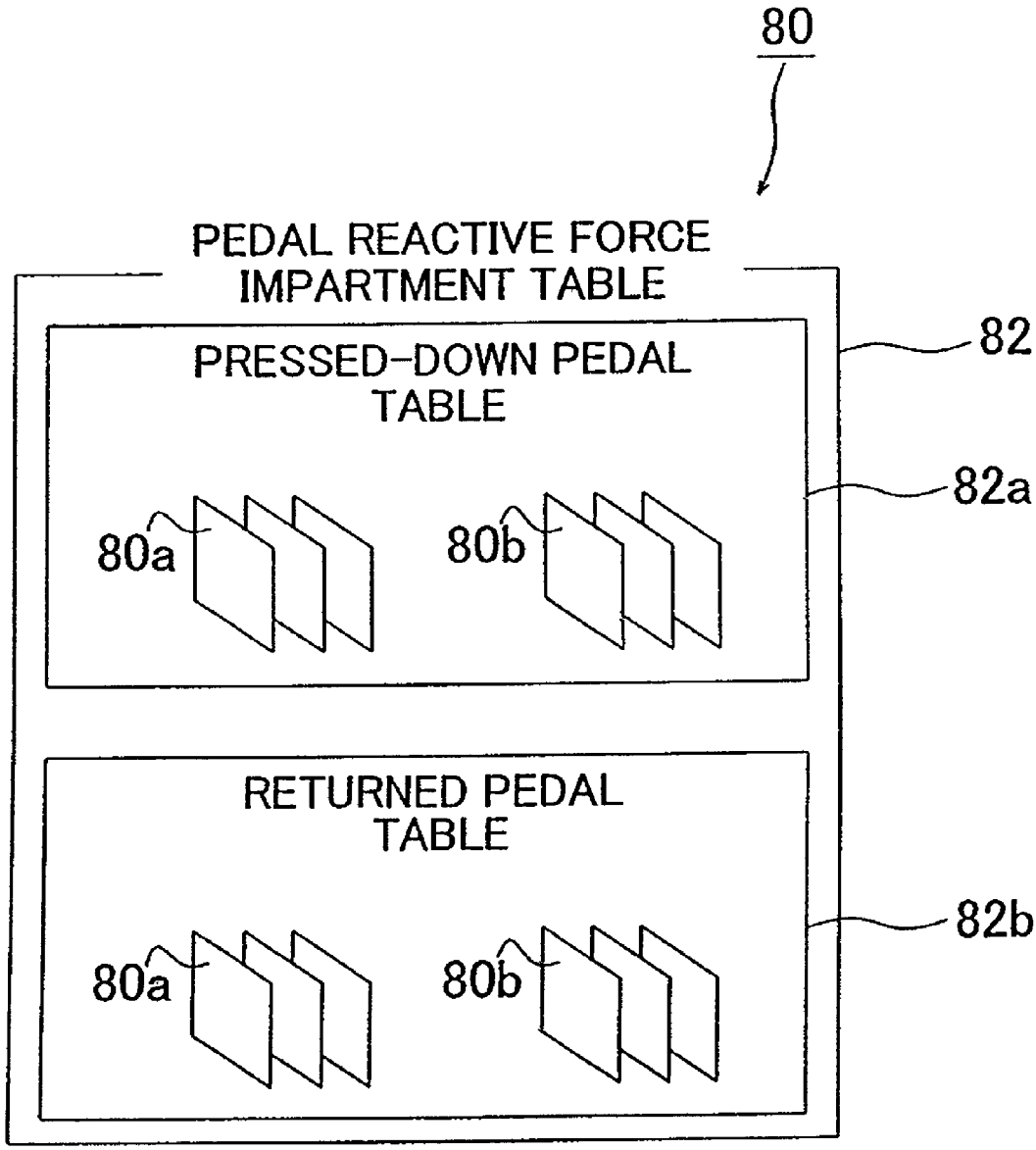
FIG. 3 is a diagram showing an example structure of a reactive force impartment table employed in the pedal device.

FIG. 3 is a diagram showing an example structure of the reactive force impartment table 80 stored in the ROM 52. The reactive force impartment table 80 includes a reference pedal reactive force impartment table 82 having stored therein patterns of the reactive force to be produced by the solenoid 40 of the pedal device 30. Pressed-down (depression) pedal table

82*a* and a returned (release)-pedal table 82*b* are included in the pedal reactive force impartment table 82. Further, each of the pressed-down pedal table 82*a* and returned-pedal table 82*b* includes a reactive force pattern table 80*a* and an instructing value table 80*b*. The reactive force pattern table 80*a* is a table for the human player or user to find an output value of the solenoid 40 corresponding to a detection value of the pedal position sensor 45 (or a value of speed, acceleration or the like of the pedal 31 calculated from the detection value of the pedal position sensor 45). The instructing value table 80*b* is a table for the user to find an instructing value for causing the solenoid 40 to generate power of the above-mentioned output value. Here, the pedal reactive force impartment table 82 is provided as a reference table as will be later described.

As shown in FIG. 1, each control signal from the control section 50 is supplied to the solenoid 40 of the pedal device 30 via a solenoid control driver (or drive control section) 48. Further, each detection signal of the pedal position sensor (movement detector) 45 is input to the control section 50.

Figure 4:
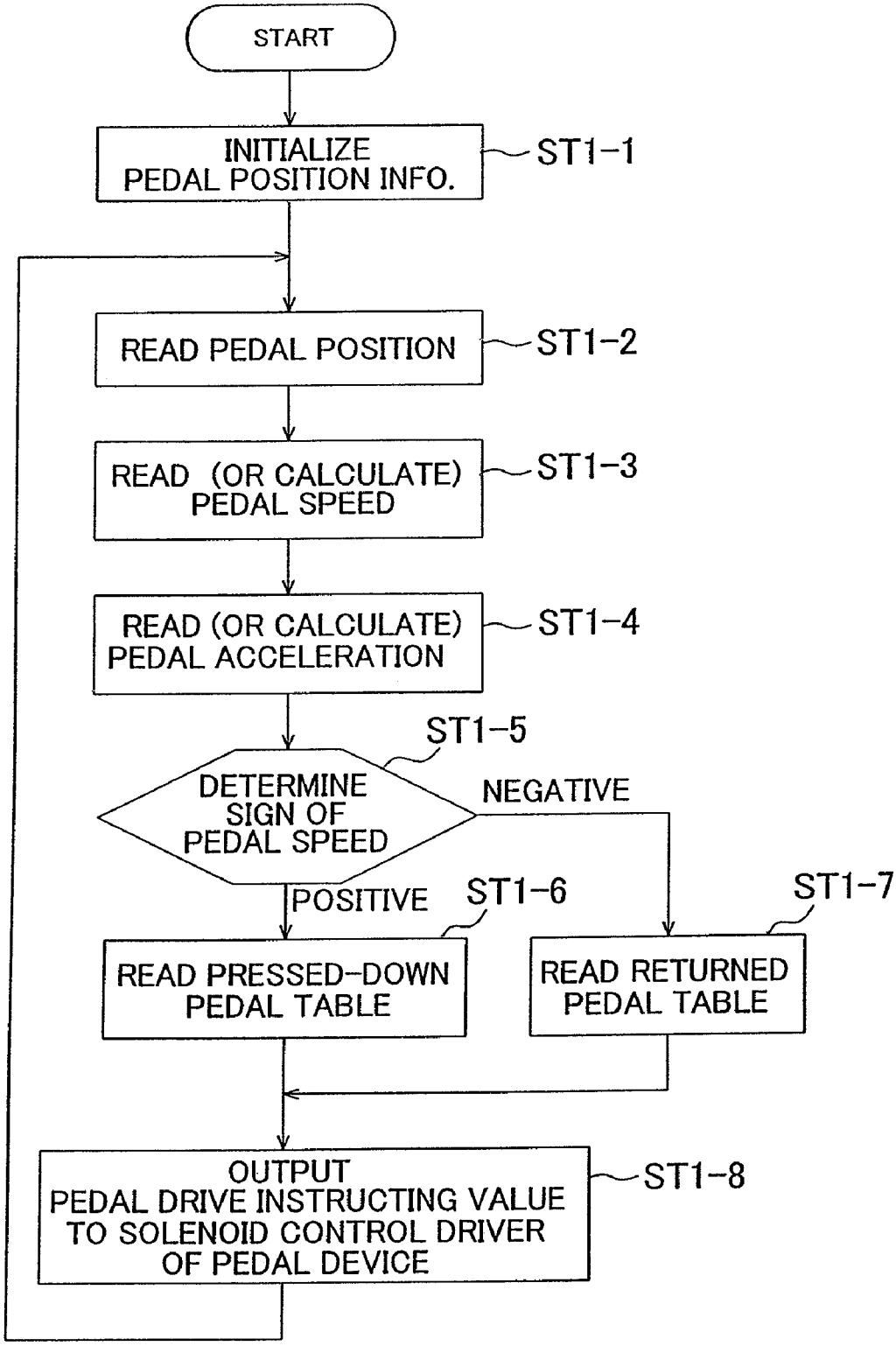
FIG. 4 is a flow chart showing an example operational sequence of reactive force control responsive to operation of a pedal in an electronic keyboard instrument.

With reference to a flow chart of FIG. 4, the following describe an example operational sequence of the reactive force control responsive to depression and/or release operation of the pedal 31 in the electronic keyboard instrument constructed in the aforementioned manner. First, at step ST1-1, position information of the pedal 31 is initialized. Then, a current position (i.e., depression/release amount) of the pedal 31 detected by the pedal position sensor 45 is read at step ST1-2. If a pedal speed sensor is provided, a speed of the pedal 31 detected by the pedal speed sensor is read at step ST1-3. Further, if a pedal acceleration sensor is provided, acceleration of the pedal 31 detected by the pedal acceleration sensor is read at step ST1-4. If no pedal speed sensor is provided, a speed of the pedal 31 may be calculated from a difference between pedal position data sequentially output by the pedal position sensor 45 (step ST1-3). Further, if no pedal acceleration sensor is provided, acceleration of the pedal 31 may be calculated from a difference between sequentially-output pedal speed data (step ST1-4). Further, if the pedal device 30 includes an angle sensor and/or angular speed sensor, an angle and/or angular speed of the pedal 31 detected by the angle sensor and/or angular speed sensor may be read.

Then, at step ST1-5, a determination is made as to whether the sign of the detected value (or calculated value) of the pedal speed read at step ST1-3 is positive or negative. If the sign of the pedal speed is positive, it means that the pedal 31 is currently in the course of being pushed or pressed down by the human player, and thus, the pressed-down (depression) pedal table 82*a* is selected and read from the pedal reactive force impartment table 82 (see FIG. 3), at step ST1-6. If, on the other hand, the sign of the pedal speed is negative, it means that the pedal 31 is currently in the course of being released from the pressing-down force, and thus, the returned (release) pedal table 82*b* is selected and read from the pedal reactive force impartment table 82, at step ST1-7. Then, not only an output level or value of the solenoid 40 is determined with reference to the reactive force pattern table 80*a* of any one of the pressed-down pedal table 82*a* and returned pedal table 82*b* which has been read at ST1-6 or ST1-7, but also an instructing value for causing the solenoid 40 to produce the determined output level or value is determined with reference to the instructing value table 80*b*. The thus-determined instructing value is output to the solenoid control driver 48 at ST1-8, to drive the solenoid 40. In this manner, a reactive force to the pedal 31 (hereinafter sometimes referred to as "pedal reactive force") is controlled on the basis of the pedal reactive force impartment table 82.

Figure 5:
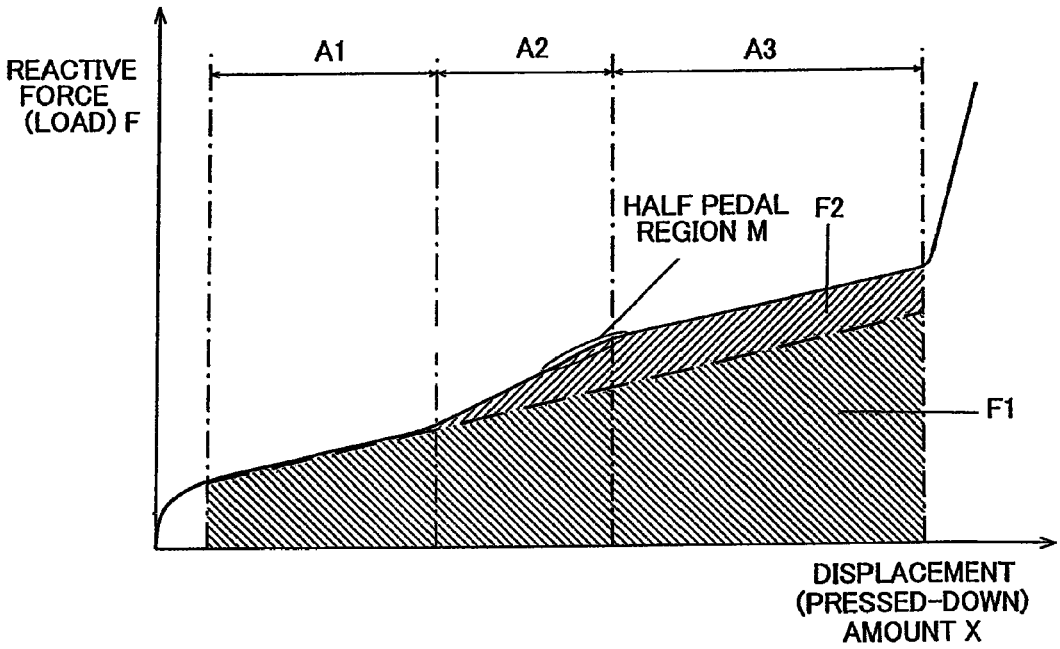
FIG. 5 is a graph showing relationship between displacement (or pressed-down) amounts of the pedal and intensities of a reactive force to be imparted to the pedal provided by the reactive force control in the first embodiment of the reactive force control apparatus.

FIG. 5 is a graph showing relationship between the displacement (or pressed-down amounts) of the pedal 31 and intensities of the reactive force (load) F to the pedal 31 provided by the above-described reactive force control. Note that this graph shows only a distribution of reactive force intensities during the pressing-down (depression) operation of the pedal 31 with illustration of a distribution reactive force intensities during the returning (release) operation of the pedal 31 omitted. Namely, the distribution reactive force intensities during the returning (release) operation of the pedal 31 should be prepared as another pattern different from the distribution of reactive force intensities during the pressing-down (depression) operation of the pedal 31. Further, the graph of FIG. 5 shows only one example of a distribution of reactive force intensities corresponding to one example or pattern of detection values of the pedal position sensor 45. Namely, for another example or pattern of detection values of the pedal position sensor 45, there is prevented another distribution of reactive force intensities different from that shown in FIG. 5. According to the reactive force control based on the pedal reactive force impartment table 82, there occur, during the pressing-down operation of the pedal 31, three different kinds of regions: a region A1 where the pedal 31 presents a small pressed-down amount and thus the reactive force presents a small variation rate; a region A2 where the pedal 31 presents an increased pressed-down amount and thus the reactive force presents an increased variation rate; and a region A3 where the pedal 31 presents a further increased pressed-down amount and thus the reactive force again presents a small variation rate. State in the acoustic piano before the load of the damper is applied to the damper pedal is reproduced in the region A1, a state in the acoustic piano where a pressing-down force starts to be transmitted to the damper via the connecting portions between the pedal and the damper and a reactive force from resilient elements of all of the connecting portions gradually increases is reproduced in the region A2, and a state in the acoustic piano where the damper is completely separated from the string to reduce friction and the reactive force from the resilient elements of all of the connecting portions no longer increases. In this way, the instant embodiment of the reactive force control apparatus can faithfully reproduce the reactive force patterns of the damper pedal of the acoustic piano, including the reactive force pattern in a half pedal region M from a latter half of the region A2 to a former half of the region A3. Thus, by suitably setting in advance a tone color and a way of sounding of a tone to be generated while the pedal 31 is in the half pedal region M, the human player of the electronic keyboard instrument can execute advanced performance operation for minutely varying a tone color and way of sounding of a tone by use of the half pedal region M.

As shown in FIG. 5, the reactive force patterns (i.e., reactive force intensity distribution patterns) in the above-described reactive force control of the present invention comprise a combination of the reactive force F1 imparted by the biasing members, i.e. return spring 35 and spring 44, and the reactive force F2 imparted by the drive member or section, i.e. solenoid 40. The reactive force in the region A1 comprises only the reactive force F1 imparted by the return spring 35 and spring 44, and the reactive force in the regions A2 and A3 comprises a comprises a combination of the reactive force F1 imparted by the return spring 35 and spring 44 and reactive force F2 imparted by the solenoid 40. Here, because the reactive force F1 is imparted by the return spring 35 and spring 44, it presents a distribution of reactive force intensities, having a substantial linear function characteristic, responsive to displacement of the pedal 31 as shown in the graph. Further, because the reactive force F2 is based on an electric driving force imparted by the solenoid 40, it presents a reactive force intensity distribution capable of emulating or reproducing the reactive force of the damper pedal of the acoustic piano, by being superposed on or combined with the reactive force F1.

As further shown in FIG. 1, the electronic keyboard instrument includes a pedal reactive force adjustment section 61 for adjusting an operational feeling (reactive force) of the pedal 31. The pedal reactive force adjustment section 61 is constructed as an operation panel provided on the setting operation section 60, and this operation panel includes a reactive force position adjusting knob (half pedal position adjusting knob) 61*a*, and a reactive force amount adjusting knob (half pedal reactive force adjusting knob) 61*b*. The reactive force position adjusting knob 61*a* is a knob for changing the position of a reactive force, produced in response to pressing-down operation (and hence displacement) of the pedal 31, to adjust the position of the half pedal region M. The reactive force amount adjusting knob 61*b* is a knob for changing the intensity of the reactive force, produced in response to pressing-down operation of the pedal 31, to adjust the amount of the reactive force in the half pedal region M. Volume value (setting value) input through operation of at least one of these knobs 61*a* and 61*b* is converted into a numerical value via a not-shown analog circuit, such as a variable resistance. The setting value is, for example, a variation amount (e.g., +2, +1, 0, −1, −2 or the like) from a reference value of the position and/or intensity of the reactive force.

Whereas the pedal reactive force adjustment section 61 has been described above in relation to the case where the volume value input through operation of at least one of the knobs 61*a* and 61*b* is converted into a numerical value, it may be provided with a means for converting the input value into a digital value via a digital circuit, or may be provided with a device, such as a counter, for inputting a previously-converted digital value.

In the electronic keyboard instrument, the content of the reference pedal reactive force impartment table 82 is changed on the basis of the setting value input through human player's operation of at least one of the knobs 61*a* and 61*b*. In this manner, the position and/or amount of the reactive force responsive to pressing-down operation of the pedal 31 is changed relative to the reference position and/or amount. The following describe an example operational sequence of a process for changing the content of the reference pedal reactive force impartment table 82.

Figures 6A, 6B:
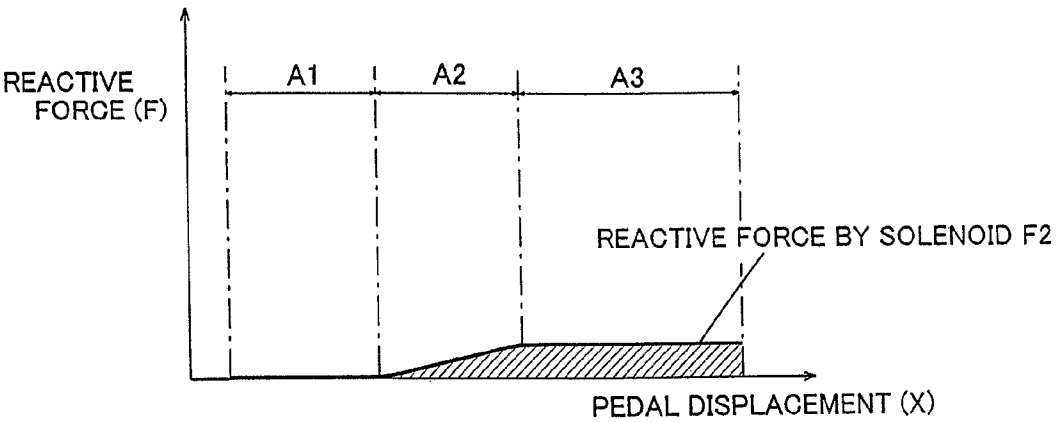
FIG. 6A is a table showing an example of relationship, defined in numerical values in the reference pedal reactive force impartment table, between various displacement amounts of the pedal and corresponding intensities of the reactive force to be imparted to the pedal by a solenoid.
FIG. 6B is a graph showing the relationship.

FIG. 6A is a table showing an example of relationship, defined in numerical values, between various displacement (stroke) amounts of the pedal 31 and corresponding intensities of the reactive force F2 to be imparted by the solenoid 40 stored in the reference pedal reactive force impartment table 82 (see FIG. 5). FIG. 6B is a graph showing relationship between various displacement (stroke) amounts of the pedal 31 and the corresponding intensities of the reactive force F2 to be imparted by the solenoid 40. The reference pedal reactive force impartment table 82 defines a distribution of intensities of the reactive force F2 as shown in the figure.

Figure 7:
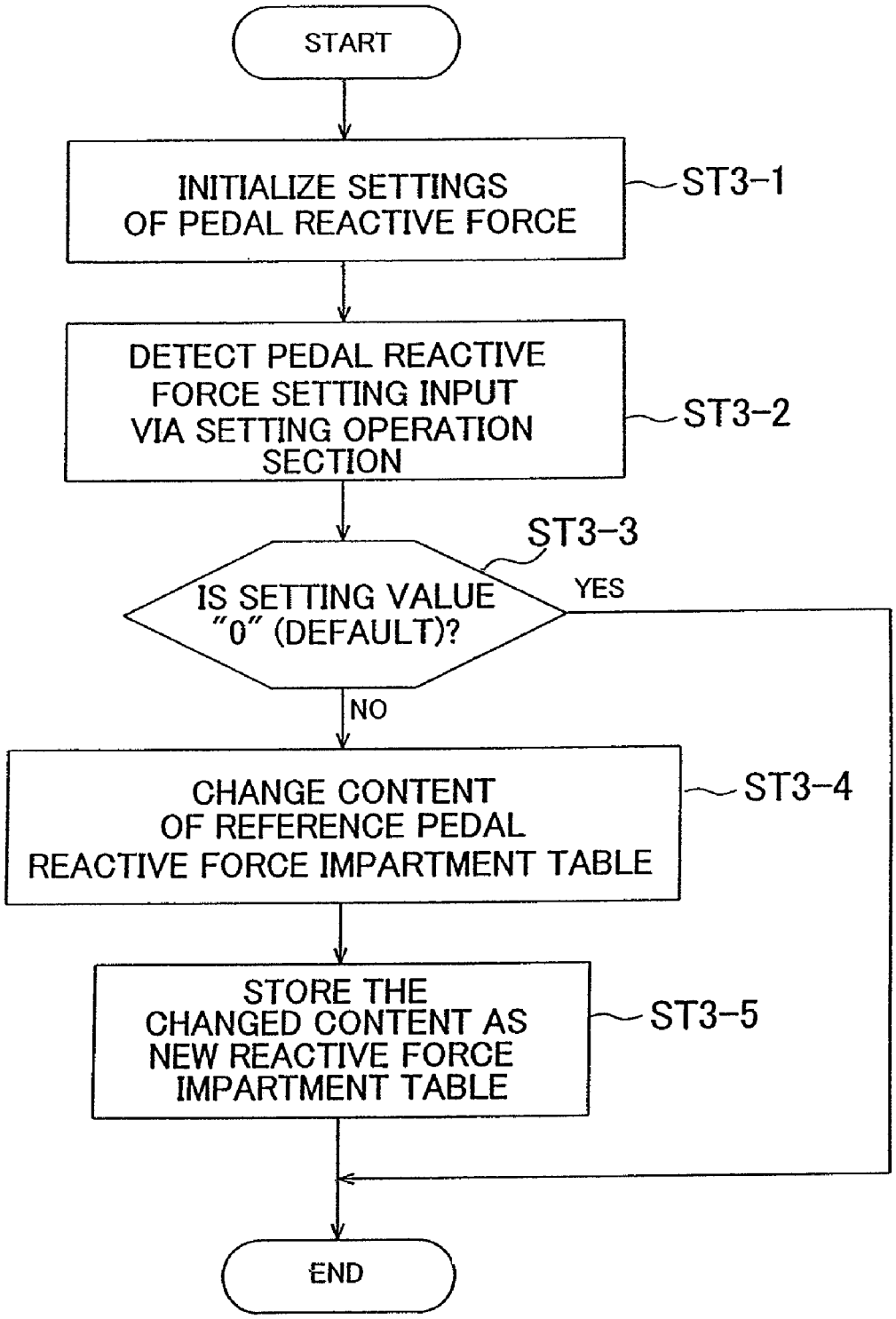
FIG. 7 is a flow chart explanatory of an example operational sequence of a process for changing the content of the reference pedal reactive force impartment table.

FIG. 7 is a flow chart explanatory of an example operational sequence of the process for changing the content of the reference pedal reactive force impartment table 82. First, at step ST3-1, current settings of the position and intensity of the reactive force to the pedal 31 are initialized. Then, at step ST3-2, detection is made of a setting value of at least one of the position and intensity of the reactive force to the pedal 31 having been input via the reactive force position adjusting knob 61*a* or reactive force amount adjusting knob 61*b*. At next step ST3-3, a determination is made as to whether the setting value detected at step ST3-2 is a default value of "0" (zero). If the detected setting value is zero (YES determination at step ST3-3), the instant process is brought to an end. Namely, in this case, the reference pedal reactive force impartment table 82 (namely, reactive force impartment table for outputting reactive force intensities shown in FIG. 5) is used as-is in the reactive force control of the pedal 31 without its content being changed.

Figures 8A, 8B:
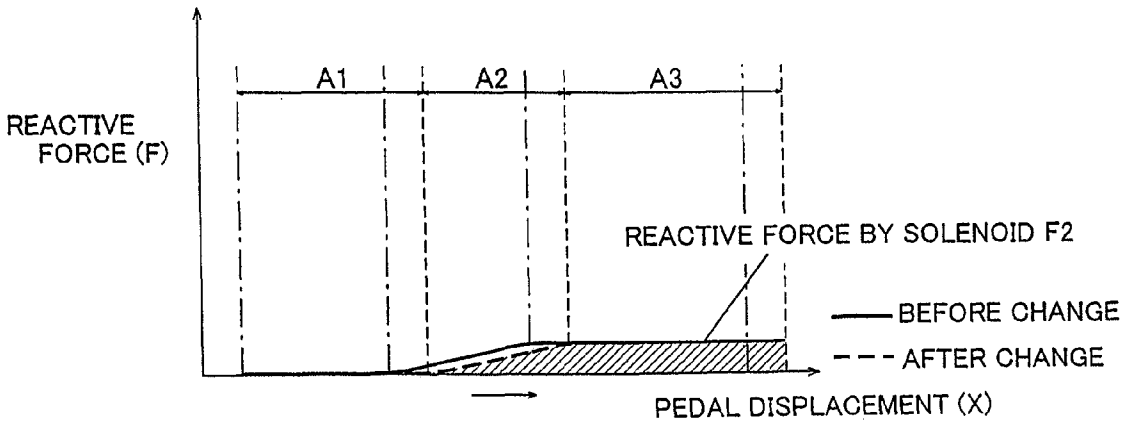
FIG. 8A is a table showing an example of intensities of the reactive force to be imparted to the pedal by the solenoid which have been changed on the basis of an input setting value of a reactive force position.
FIG. 8B is a graph showing a distribution of the changed intensities of the reactive force.

If, on the other hand, the detected setting value is not zero (NO determination at step ST3-3), the reactive force intensity patterns (content) are changed at step ST3-4, so that the thus-changed reactive force intensity patterns (content) are set as a new pedal reactive force impartment table 82 and stored in a storage means, such as the RAM 53 at step ST3-5. FIG. 8A is a table showing an example of intensities of the reactive force F2 to be imparted by the solenoid 40 which have been changed on the basis of the setting value of the reactive force position having been input via the reactive force position adjusting knob 61*a*, and FIG. 8B is a graph showing the changed intensities of the reactive force F2 to be imparted by the solenoid 40. More specifically, the graph of FIG. 8B shows the positions where the reactive force F2 is to be produced by the solenoid 40 having been shifted, on the basis of the setting value input via the reactive force position adjusting knob 61*a*, by +2 in a displacement direction of the pedal 31. In this manner, the operational feeling of the pedal 31 is changed in such a way that the half pedal region M shifts in a positive direction of the displacement X of the pedal 31, i.e. in a direction where the pressing-down of the pedal 31 becomes deeper.

Figures 9A, 9B:
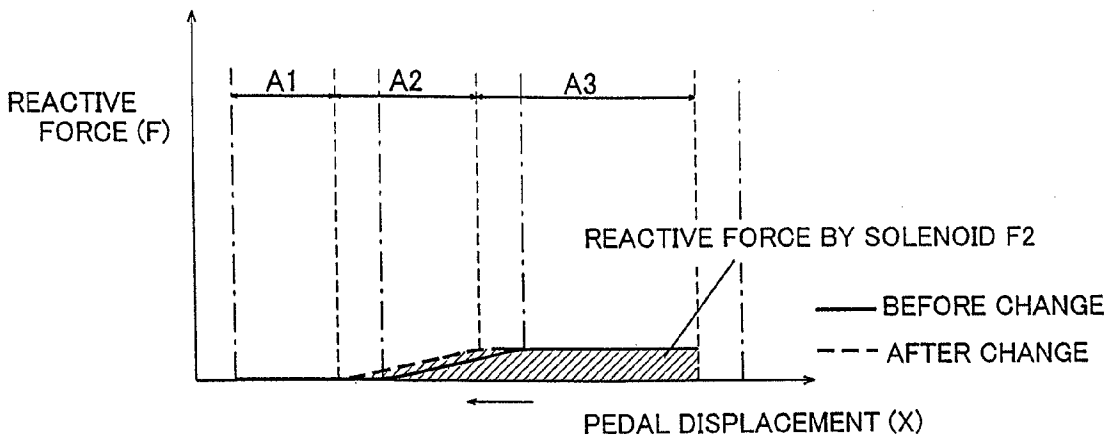
FIG. 9A is a table showing another example of the intensities of the reactive force to be imparted to the pedal by the solenoid which have been changed on the basis of an input setting value of the reactive force position.
FIG. 9B is a graph showing a distribution of the changed intensities of the reactive force.

FIG. 9A is a table showing another example of intensities of the reactive force F2 to be imparted by the solenoid 40 which have been changed on the basis of the setting value of the reactive force position having been input via the reactive force position adjusting knob 61*a*, and FIG. 9B is a graph showing the changed intensities of the reactive force F2. More specifically, the graph of FIG. 9B shows the positions where the reactive force F2 is to be produced by the solenoid 40 having been shifted, on the basis of the setting value input via the reactive force position adjusting knob 61*a*, by −2 in the displacement direction of the pedal 31. In this manner, the operational feeling of the pedal 31 is changed in such a way that the half pedal region M shifts in a negative direction of the displacement X of the pedal 31, i.e. in a direction where the pressing-down of the pedal 31 becomes shallower.

Figures 10A, 10B:
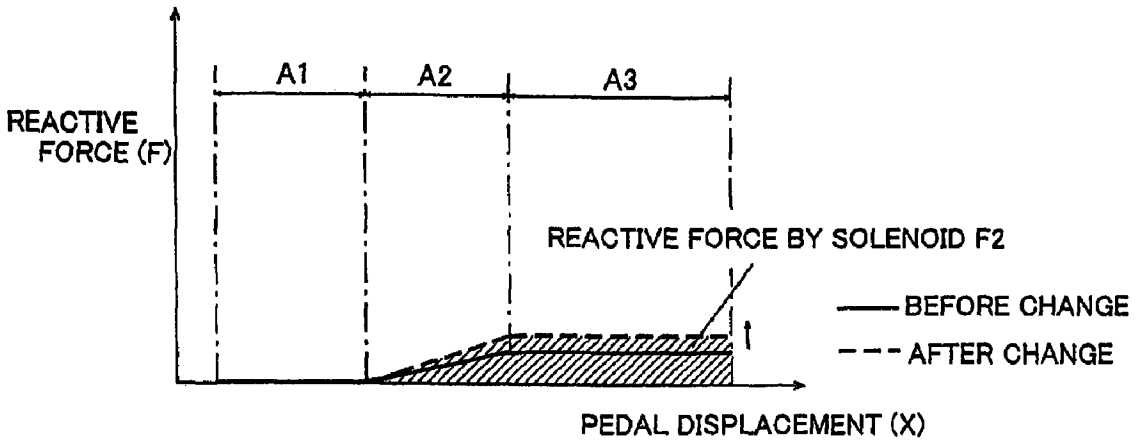
FIG. 10A is a table showing an example of intensities of the reactive force to be imparted to the pedal by the solenoid which have been changed on the basis of a setting value of an input reactive force intensity.
FIG. 10B is a graph showing a distribution of the changed intensities of the reactive force.

FIG. 10A is a table showing an example of intensities of the reactive force F2 to be imparted by the solenoid 40 which have been changed on the basis of the setting value having been input via the reactive force amount adjusting knob 61*b*, and FIG. 10B is a graph showing the intensities of the reactive force F2. Here, the intensities of the reactive force F2 have been increased by the intensities of the reactive force F2 throughout an entire displaceable region of the pedal 31 being multiplied by a predetermined value (+1.2 in this case) on the basis of the setting value having been input via the reactive force amount adjusting knob 61*b*. In this manner, the operational feeling of the pedal 31 is changed in such a way that the reactive force F2 at individual pressed-down positions of the pedal 31 increases in intensity at a predetermined multiplying factor.

Figures 11A, 11B:
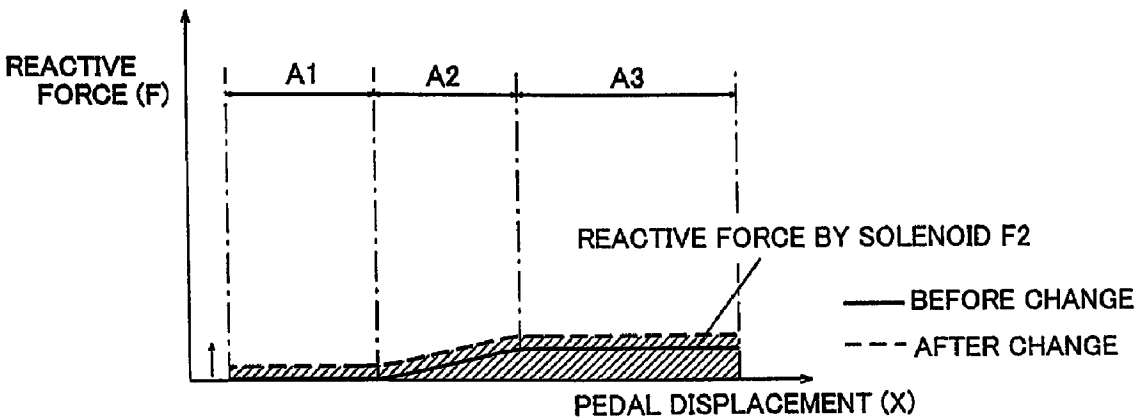
FIG. 11A is a table showing another example of the intensities of the reactive force to be imparted to the pedal by the solenoid which have been changed on the basis of an input setting value of a reactive force intensity.
FIG. 11B is a graph showing a distribution of the changed intensities of the reactive force.

FIG. 11A is a table showing another example of intensities of the reactive force F2 to be imparted by the solenoid 40 which have been changed on the basis of the setting value having been input via the reactive force amount adjusting knob 61*b*, and FIG. 11B is a graph showing the intensities of the reactive force F2. Here, the intensities of the reactive force F2 have been increased by adding a predetermined value (+2 in this case) to the intensities of the reactive force F2 throughout the entire displaceable region of the pedal 31 on the basis of the setting value having been input via the reactive force amount adjusting knob 61*b*. In this manner, the operational feeling of the pedal 31 is changed in such a way that the reactive force F2 increases in intensity with uniform increments.

The instant embodiment of the reactive force control apparatus has been described as changing the content (stored values) of the pedal reactive force impartment table 82 on the basis of the setting value of the position and/or intensity input via the setting operation section 60 and stores the thus-changed content as a new pedal reactive force impartment table 82. Alternatively, the instant embodiment of the reactive force control apparatus may be constructed to output a value of the pedal reactive force value by multiplying a reference pedal reactive value, extracted from the reference pedal reactive force impartment table 82, by a constant corresponding to a setting value input via the setting operation section 60. In this manner, a desired change to the pedal reactive force value corresponding to the input setting value is permitted by only performing a simple multiplication operation on the reference pedal reactive value and without changing the pedal reactive force impartment table 82, and thus, the desired change to the pedal reactive force value corresponding to the input setting value can be made with an increased enhanced ease.

The instant embodiment of the reactive force control apparatus, which normally performs the reactive force control on the pedal 31 in accordance with the operational sequence of FIG. 4, may perform the reactive force control on the pedal 31 using the new pedal reactive force impartment table calculated at step ST3-4 above in place of the reference pedal reactive force impartment table 82. In the aforementioned manner, a reactive force can be produced in response to operation of the pedal 31 in accordance with a setting value input by the human player itself; namely, the instant embodiment can achieve a reactive force to the pedal as desired by a human player. Further, because the reactive force F2 to be imparted by the solenoid 40 is changed in position and/or intensity in the manner as shown in the graph of FIG. 5, the reactive force in the regions A2 and A3 can be changed. Thus, the human player is allowed to perform advanced performance operation for minutely varying a tone color etc. of a tone using a desired half pedal region Whereas the embodiment has been described as including both the spring 44 connected to the rod 42 of the solenoid 40 and the return spring 35 abutted directly against the pedal 31 to impart a reactive force to the pedal 31, the means for imparting a reactive force in response to pressing-down operation of the pedal 31 may comprise only one of the return spring 35 and spring 44; namely, the other of the return spring 35 and spring 44 may be dispensed with.

Further, the biasing means employed in the pedal device 30 of FIG. 2 may comprise other than the spring 44 and return spring 35. Although not specifically shown, the biasing means may comprise a spring connected to the pedal 31, pivotable about the pedal 34, via a link mechanism pivotably connected to the pedal 31. With such a structure having the link mechanism, a hysteresis can be easily produced, through friction occurring in the link mechanism, in the pressing-down and returning strokes of the pedal 31. With such a hysteresis, there can be readily obtained an operational feeling approximate to that of the pedal of the acoustic piano, although the provision of the link mechanism would undesirably increase the overall scale of the pedal device. Further, although not specifically shown, even the pedal device 30 constructed in the manner shown in FIG. 2 allows a hysteresis to be produced in the pressing-down and returning strokes.

Second Embodiment

The following describe a second embodiment of the reactive force control apparatus for a pedal of an electronic keyboard instrument. In the following description about the second and other embodiments and corresponding drawings, the same elements as in the first embodiment are indicated by the same reference numerals and characters and will not be described here to avoid unnecessary duplication. The second embodiment of the electronic keyboard instrument is provided with a pedal device different in construction from the pedal device 30 provided in the first embodiment.

Figure 12A:
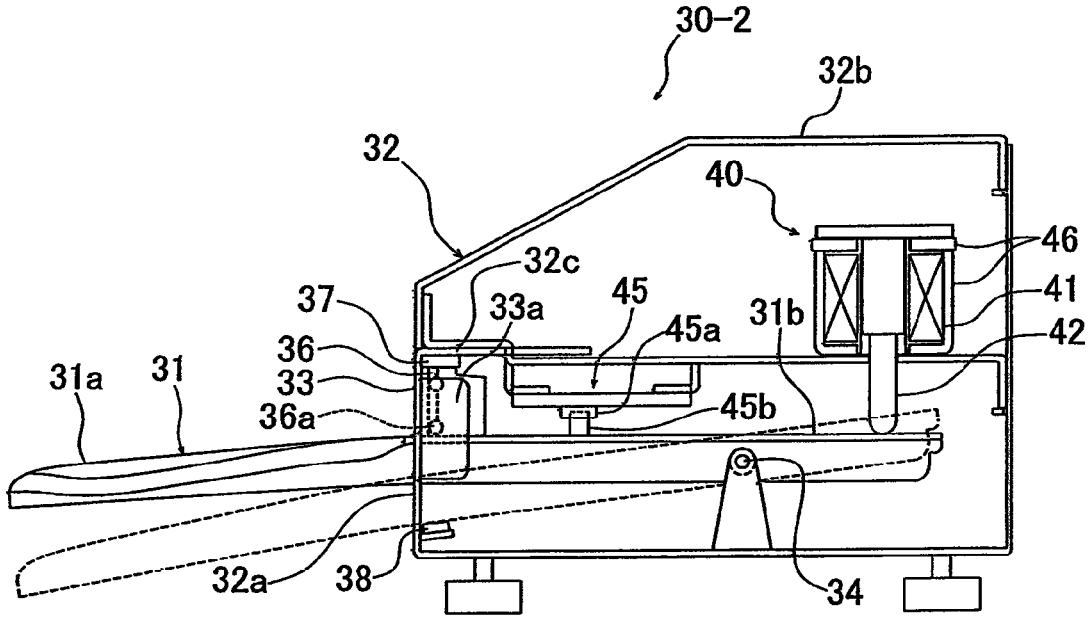
FIG. 12A is a schematic sectional side view of a pedal device according to a second embodiment of the invention.
Figure 12B:
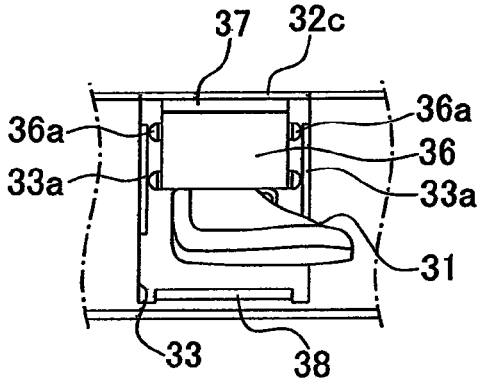
FIG. 12B is a front view of the pedal device.

FIG. 12 shows a construction of the pedal device 30-2 in the second embodiment, of which FIG. 12A is a schematic sectional side view of the pedal device 30-2 and FIG. 12B is a front view of the pedal device 30-2. The pedal device 30-2 in the second embodiment does not include the return spring 35 and spring 44 provided as the biasing means in the pedal device 30 of the first embodiment, so that a reactive force responsive to pressing-down operation of the pedal 31 is produced by the solenoid 40 alone in the second embodiment.

Figure 13:
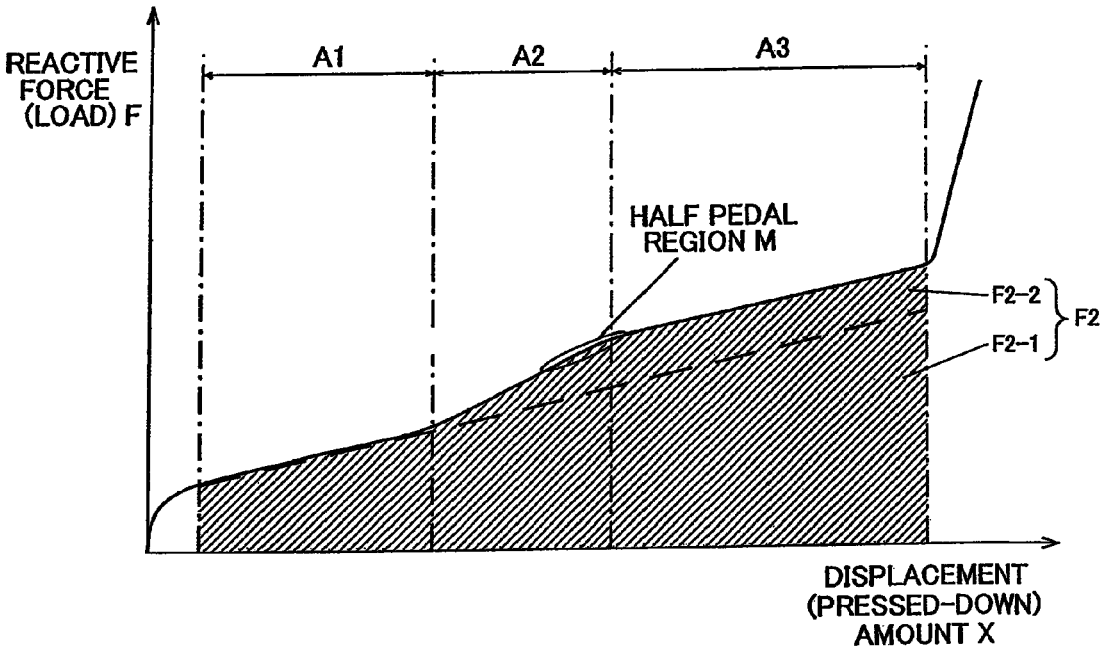
FIG. 13 is a graph showing relationship between displacement amounts of the pedal and intensities of a reactive force to be imparted to the pedal provided by reactive force control in the second embodiment of the invention.

FIG. 13 is a graph showing relationship between the displacement X of the pedal 31 and the reactive force F to the pedal 31 subjected to reactive force control by the pedal device 30-2. Note that this graph too shows only a distribution of reactive force intensities only during the pressing-down operation of the pedal 31 with illustration of a reactive force distribution during the returning operation of the pedal 31 omitted. The graph of FIG. 13 too shows only one example of a reactive force distribution corresponding to only one example of detection values of the pedal position sensor 45. Whereas the patterns (shapes), illustrated in FIG. 13, of the reactive force F responsive to the displacement X of the pedal 31 are the same as those of FIG. 5 employed in the first embodiment, the reactive force imparted in the second embodiment consists only of the reactive force F2 produced by the solenoid 40. Here, the reactive force F2 produced by the solenoid 40 is a combination of a reactive force F2-1 and reactive force F2-2 having different patterns. The reactive force F2-1 has the same patterns as the reactive force F1 produced by the return spring 35 and spring 44 in the first embodiment, while the reactive force F2-2 has the same patterns as the reactive force F2 produced by the solenoid 40 in the first embodiment.

The pedal reactive force impartment table 82 comprises two kinds of tables D1 and D2 differing from each other in numerical values stored therein. The table D1 is a table storing the same numerical values as the reference pedal reactive force impartment table 82 of FIG. 6 employed in the first embodiment, while the table D2 is a table storing numerical values set so as to produce the same reactive force F1 based on the return spring 35 or spring 44 as in the first embodiment.

The reactive force F2-1 is produced on the basis of the table D1, while the reactive force F2-2 is produced on the basis of the table D2. Only the reactive force F2-1 based on the table D1 is produced in the first area A1, and a combination of the reactive force F2-1 based on the table D1 and reactive force F2-2 based on the table D2 is produced in the second and third areas A2 and A3.

In the second embodiment of the reactive force control apparatus too, the positions and/or intensities of the reactive force defined in the reference pedal reactive force impartment table 82 can be changed on the basis of a setting value input via the pedal reactive force adjustment section 61, so that the reactive force control can be performed on the pedal 31 using the thus-changed reactive force impartment table 82, as set force above. Note that the reference pedal reactive force impartment table 82 in the second embodiment can be changed in accordance with generally the same operational sequence as in the first embodiment. However, in this embodiment, only the reactive force F2-2 having the same patterns as the reactive force F2 imparted by the solenoid 40 in the first embodiment is changed without the reactive force F2-1 having the same patterns as the reactive force F1 imparted by the return spring 35 and spring 44 in the first embodiment being changed. The change of the reactive force F2-2 may be changed in accordance with generally the same operational sequence as in the first embodiment.

With the above-described second embodiment of the reactive force control apparatus, which controls the solenoid 40 using the two tables D1 and D2 differing from each other in numerical values defined therein, it is possible to adjust the positions or intensities in the half pedal region. By thus driving the solenoid 40 using the two different tables D1 and D2, the pedal device in the second embodiment can produce, by use of the solenoid 40 alone, the same reactive force to the pedal as the pedal device 30 in the first embodiment, provided with both the return spring 35 and spring 44, by use of the solenoid 40.

Whereas the foregoing have described the preferred embodiments of the present invention, the present invention is not limited to the above-described embodiments and may be modified variously within the scope of the technical idea. In the case where a reactive force is imparted to the pedal 31 by the return spring 35 and spring 44 provided as biasing force imparting means as well as the solenoid 40 provided as electric drive means as in the first embodiment, the reactive force to be produced by the solenoid 40 can be smaller in level than in the case where a reactive force is imparted to the pedal 31 by the solenoid 40 alone as in the second embodiment. Thus, in the former case, the solenoid 40 and components peripheral thereto can be not only simplified in construction but also reduced in size, and thus, the size and weight of the pedal device 30 can be reduced. Further, because only small electric power is necessary for driving the solenoid 40, power consumption by the electronic keyboard instrument can be reduced.

Further, the preferred embodiments have been described above in relation to the case where the solenoid 40 is provided as the drive means for imparting a reactive force responsive to operation of the pedal 31, such a drive means is not limited to the solenoid and may be an actuator constructed differently from the solenoid.

Furthermore, whereas FIGS. 5 and 13 each show an example of a reactive force distribution corresponding to one example of pedal position detection values output by the pedal position sensor in response to pressing-down operation of the pedal, it is highly conceivable that, if the piano used is replaced with another piano of the same or different model, the reactive force distribution will differ, even for the same detection values output by the pedal position sensor, depending on an individual difference or structural difference. The basic principles of the present invention are also applicable to apparatus having a reactive force distribution differing depending on such an individual difference or model.

This application is based on, and claims priority to, JP PA 2008-165039 filed on 24 Jun. 2008. The disclosure of the priority application, in its entirety, including the drawings, claims, and the specification thereof, is incorporated herein by reference.

What is claimed is:

1. A reactive force control apparatus for a pedal of an electronic keyboard apparatus, comprising:

a pedal supported for movement in response to at least one of depression and release operation performed thereon;

a movement detection section that detects movement of the pedal;

a drive section that produces a reactive force to be imparted to the pedal, based on an electric driving force thereof, in response to the at least one of depression and release operation of the pedal;

a reference reactive force impartment table defining intensities of the reactive force corresponding to amounts of the at least one of depression and release operation of the pedal;

a setting value input section operable to input a setting value for setting a reactive force responsive to the at least one of depression and release operation of the pedal; and a reactive force control section that controls the reactive force to be produced by said drive section, said reactive force control section changing content of the reference reactive force impartment table, on the basis of the setting value inputted via said setting value input section, to thereby create a changed reactive force impartment table, so that said reactive force control section controls the reactive force to be produced by said drive section by referring to the changed reactive force impartment table in accordance with a pedal movement detection signal outputted by said movement detection section.

2. The reactive force control apparatus as claimed in claim 1 wherein the reactive force to be imparted to the pedal has a characteristic that a variation rate of the reactive force responsive to the at least one of depression and release amount of the pedal changes at a particular displacement amount in a displaceable region of the pedal; and said reactive force control section creates the changed reactive force impartment table by changing, on the basis of the setting value inputted via said setting value input section, any one or more of a value of the particular displaced amount, variation rate of the reactive force in a predetermined region and intensity of the reactive force set in the reference reactive force impartment table.

3. The reactive force control apparatus as claimed in claim 2 which further comprises a biasing member that imparts a reactive force, based on a mechanical biasing force thereof, to the pedal in response to the operation of the pedal, and wherein the displaceable region of the pedal has first to third regions continuous with each other, the reactive force to the pedal based on the reference reactive force impartment table and said biasing member having a greater variation rate in the second region than in the first and third regions, the reactive force based on the biasing force of said biasing member alone is imparted to the pedal in the first region while a combination of the reactive force based on the biasing force of said biasing member and the reactive force based on the electric driving force of said drive section is imparted to the pedal in the second and third regions, and said reactive force control section changes the reactive force to be imparted in the second and third regions, by changing, on the basis of the setting value inputted via said setting value input section, a position and/or intensity of the reactive force to be produced by said drive section.

4. The reactive force control apparatus as claimed in claim 2 wherein the reactive force to the pedal based on the reference reactive force impartment table has a greater variation rate in the second region than in the first and third regions, said reference reactive force impartment table comprises first and second tables differing from each other in content, and the reactive force based on the first table alone is imparted to the pedal in the first region while a combination of the reactive forces based on said first and second tables is imparted to the pedal in the second and third regions.

5. The reactive force control apparatus as claimed in claim 4 wherein said reactive force control section changes the content of said second table, on the basis of the setting value inputted via said setting value input section, so that said reactive force control section changes the reactive force in said second and third regions by changing positions and/or intensities of the reactive force based on said second table.

* * * * *